US006777890B1

(12) United States Patent
Huang

(10) Patent No.: US 6,777,890 B1
(45) Date of Patent: Aug. 17, 2004

(54) CYLINDRICAL MINIATURE-LED LIGHT-EMITTING DEVICE

(76) Inventor: Chin-Lin Huang, 1F, No. 5, Kuang Cheng St., Panchiao 220, Taipei Hsien (TW)

( * ) Notice: Subject to any disclaimer, the term of this patent is extended or adjusted under 35 U.S.C. 154(b) by 0 days.

(21) Appl. No.: 10/465,592

(22) Filed: Jun. 20, 2003

(51) Int. Cl.[7] ..... H05B 37/00; G09F 13/22

(52) U.S. Cl. ..... 315/200 A; 315/185 S; 362/812; 362/806; 362/800

(58) Field of Search ..... 315/200 A, 185 S; 362/806, 808, 812, 800; 365/56, 57, 58

(56) References Cited

U.S. PATENT DOCUMENTS 6,398,383 B1 * 6/2002 Huang ..... 362/202

6,585,388 B2 * 7/2003 Kim ..... 362/118

* cited by examiner

*Primary Examiner*—Tuyet T. Vo
(74) *Attorney, Agent, or Firm*—Bacon & Thomas, PLLC

(57) ABSTRACT

The cylindrical miniature-LED light-emitting device. The device is provided on a front end of a metal cylinder thereof having therein an LED assembly and a battery assembly with a socket to receive the LED. The LED assembly is constructed from the LED and a push switch is mounted in the metal cylinder. The LED protrudes from the socket to a section on the front end of the metal cylinder. By pressing the LED on the front end of the metal cylinder and then touching the push switch, turning on/off of the light of the LED can be effected. Particularly, the LED light-emitting device works through the action of directly touching the push switch by the LED without providing additional components for turning on/off by triggering.

4 Claims, 5 Drawing Sheets

CYLINDRICAL MINIATURE-LED LIGHT-EMITTING DEVICE

BACKGROUND OF THE INVENTION

1. Field of the Invention

The present invention is related to a cylindrical miniature LED light-emitting device, it provides a miniature-LED light-emitting device with a simple structure convenient for operation, and especially to an LED light-emitting device that works through the action of directly press touching a push switch by an LED without providing additional components for turning on/off by triggering, thereby it even more meets the light-and-handy design requirement of the miniature-LED light-emitting device.

2. Description of the Prior Art

Since LED's (light emitting diodes) possess the characteristics of small volume, low heat and long service life etc., they have widely replaced the traditional bulbs for use as light-emitting devices such like flashlights, and light-emitting devices join with key rings etc. And because the common LED light-emitting devices combining with key rings generally belong to the miniature and facile structure design that meets the convenience of carrying and using, the entire structure not only includes LED components, batteries and the structure controlling light emitting of the LED, but also has the material of the entire light-emitting device produced of conductive metal to omit the circuit allocation for the batteries and the LED.

In the most common structure of a normal miniature LED device, the components such as an LED and batteries are received in a metal cylinder constructed with screws to obtain the goal of controlling turning on/off of the LED through turning the metal cylinder to control connecting/disconnecting of the circuit between the LED and the batteries; however, although such structure can work in controlling turning on/off of the LED by turning the metal cylinder appropriately, it is less convenient to operate, and unable to judge whether the turning direction is what has been expected to make lighten or turn off of the LED, and the whole metal cylinder is separated frequently because of over rotation to render the components such as the batteries to drop and lose.

SUMMARY OF THE INVENTION

The cylindrical miniature-LED light-emitting device of the present invention is mainly provided on the front end of a metal cylinder thereof having therein an LED assembly and a battery assembly with a socket to receive the LED, and the LED assembly which is constructed from the LED and a push switch in the metal cylinder, wherein the LED protrudes from the socket to a given section on the front end of the metal cylinder; therefore, this constructs the structure of the LED light-emitting device wherein by pressing the LED on the front end of the metal cylinder and then touching the push switch, controlling turning on/off of the light of LED can be effected.

Particularly, the LED light-emitting device works through the action of directly touching the push switch by the LED without providing additional components for turning on/off by triggering, thereby it even more meets the light-and-handy design requirement of the miniature-LED light-emitting device.

The present invention will be apparent in its structure as well as the mode of operation after reading the detailed description of the preferred example thereof in reference to the accompanying drawings.

DETAILED DESCRIPTION OF THE PREFERRED EMBODIMENT

Figure 1:
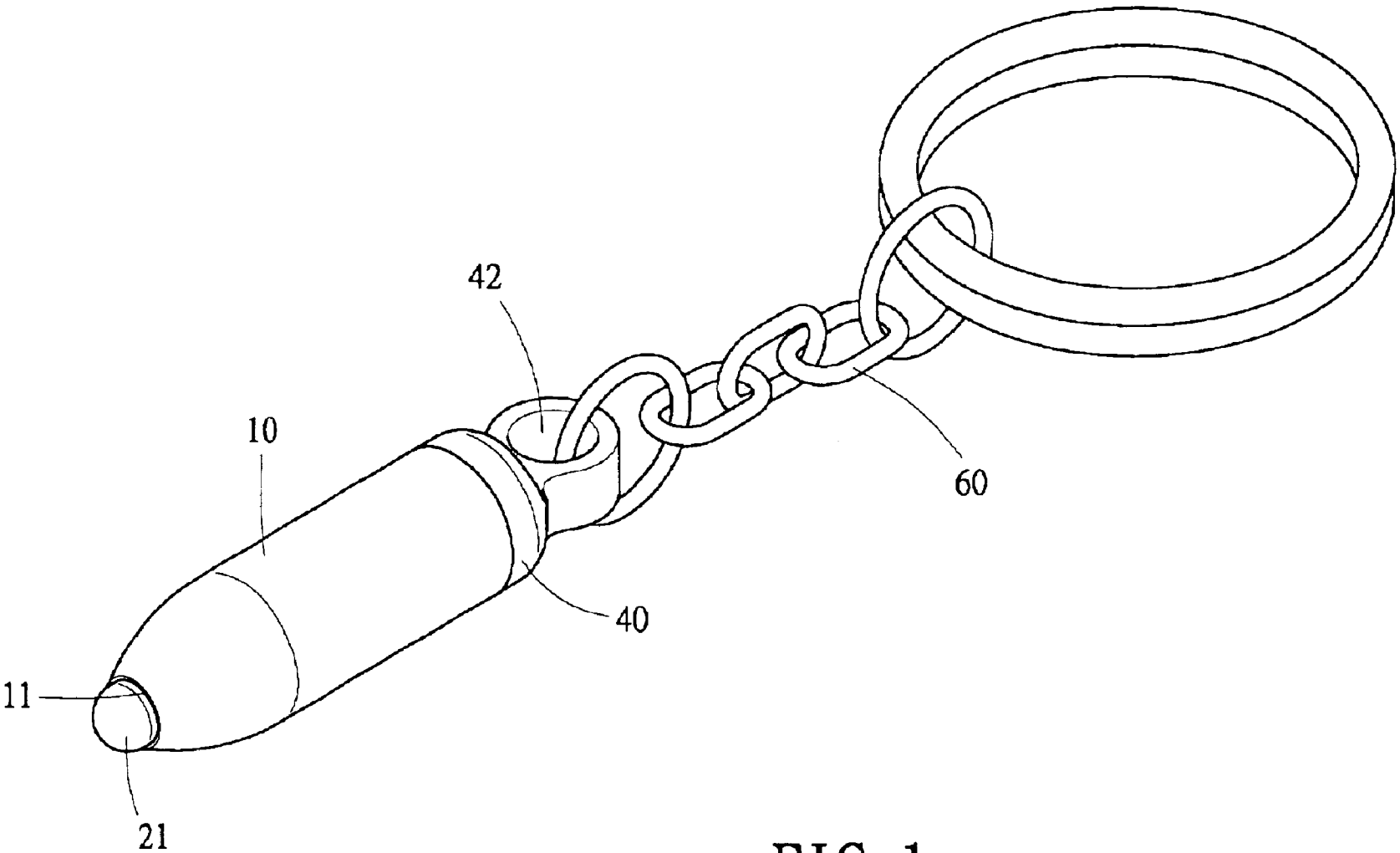
FIG. 1 is a perspective view showing the appearance of the entire LED light-emitting device of the present invention.
Figure 2:
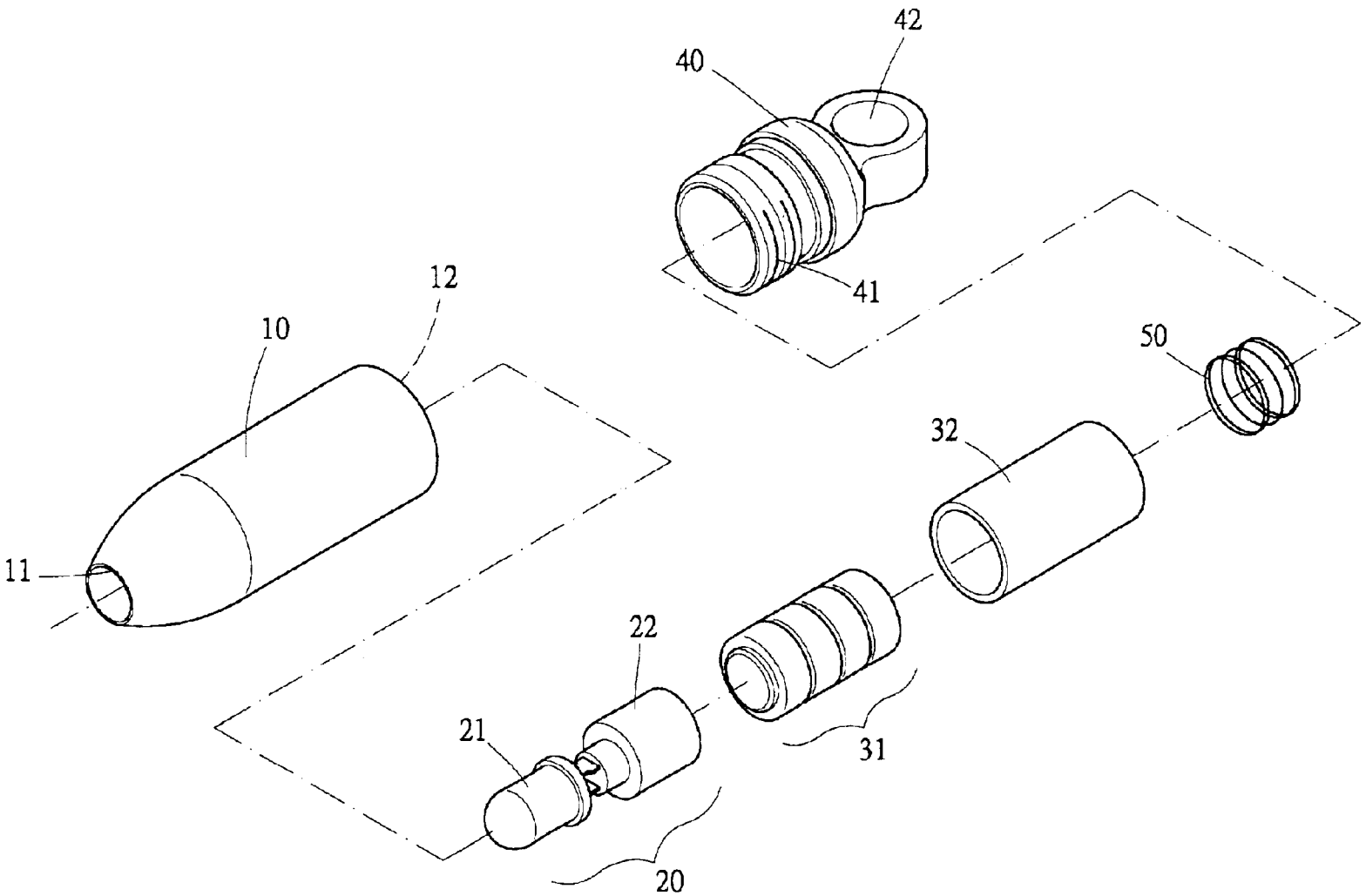
FIG. 2 is an analytic perspective view showing the structure of the LED light-emitting device of the present invention.
Figure 3:
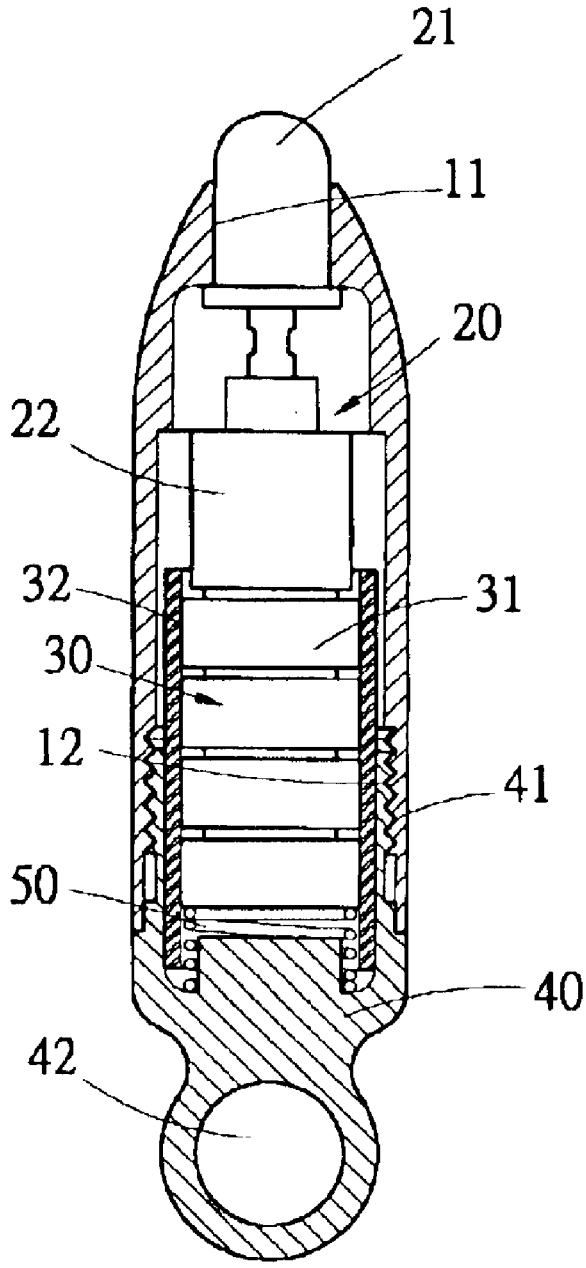
FIG. 3 is a structure section view of the LED light-emitting device of the present invention.

Referring to FIGS. 1, 2 and 3, the constructed structure of the entire LED light-emitting device of the present invention includes:

A metal cylinder 10 being the main body to receive an LED assembly 20 and a battery assembly 30, the metal cylinder 10 is provided on the front end thereof with a socket 11 to receive an LED 21, and is provided on the rear end thereof with a first thread section 12 to screw connect a metal end cover 40.

The LED assembly 20 is a component consisting of the LED 21 and a push switch 22, and is installed inside of the metal cylinder 10; the LED 21 protrudes from the socket 11 to a given section on the front end of the metal cylinder 10.

The battery assembly 30 is a component consisting of at least a battery 31 and a bush 32, and is installed inside of the metal cylinder 10, the LED assembly 20 of the battery 31 is connected with the push switch 22.

The metal end cover 40 is provided with a second thread section 41 to be screw connected on the rear end of the metal cylinder 10, and the abovementioned components including the LED assembly 20, the battery assembly 30 etc. are fixedly provided in the metal cylinder 10 to form an electric current path between the battery 31 and the metal cylinder 10, and the structure of the completed LED light-emitting device is made. And as shown in FIG. 1, the metal end cover 40 is provided with a through ring 42 additionally, to render the entire LED light-emitting device to connect with an extending-through-for-hanging item 60 such as a key ring, and also to increase the applicability of the LED light-emitting device.

Figure 4:
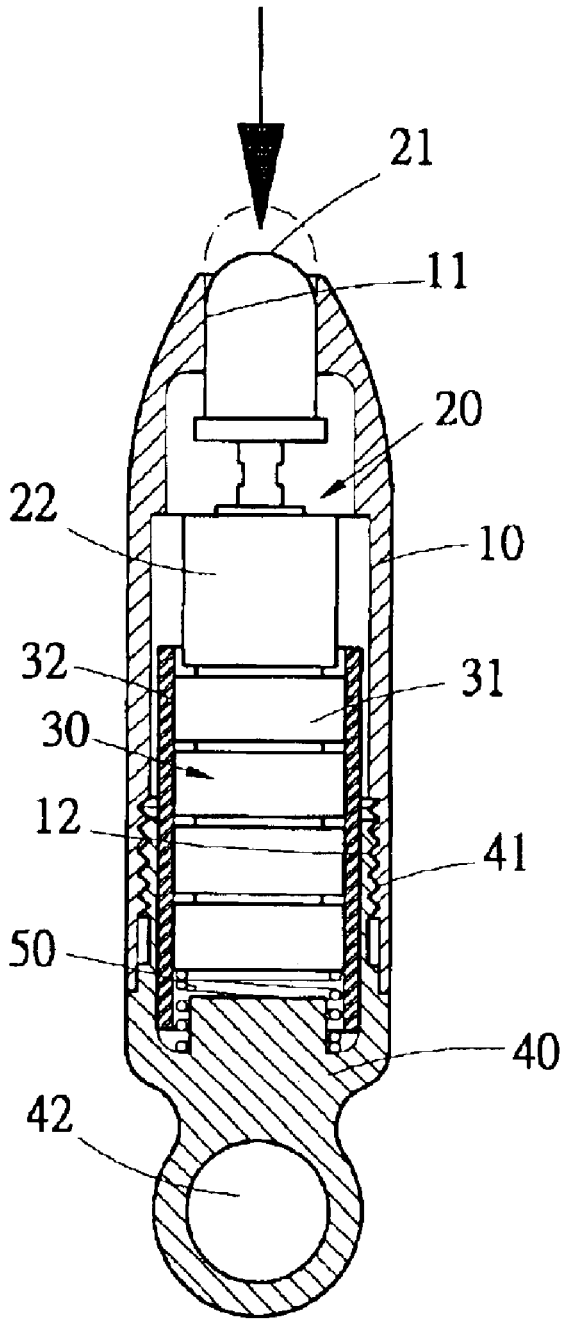
FIG. 4 is an action schematic view of the LED light-emitting device of the present invention.

Whereas, the way of action of the entire LED light-emitting device is as shown in FIG. 4, by means of pressing the LED 21 on the front end of metal cylinder 10 and in turn touching the push switch 22, the goal of controlling turning on/off of the light of the LED 21 can be attained. Thereby the present invention not only bears the characteristic of being a simple structure, but also has the advantage of giving convenient operation; especially, through the way of action by using the LED 21 to directly touch the push switch 22, it is not necessary to provide additional components for turning on/off by triggering, thereby the present invention even more meets the light-and-handy design requirement of the miniature-LED light-emitting device.

Figure 5:
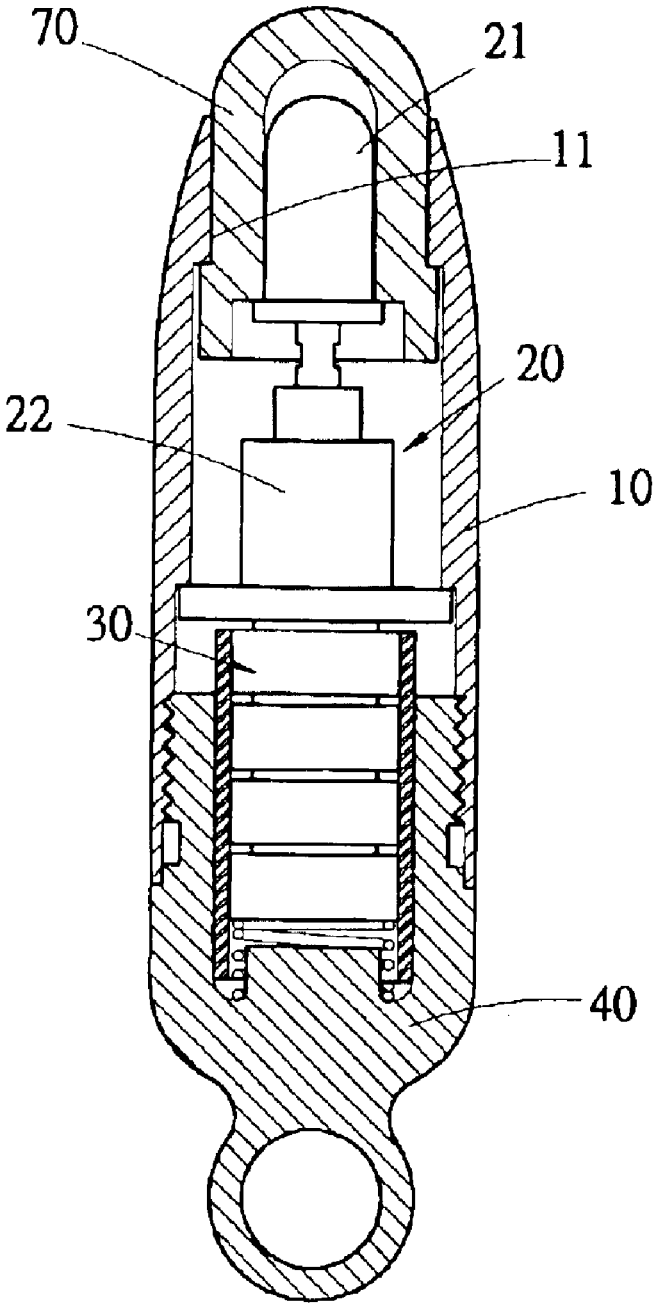
FIG. 5 is a structure section view of the LED light-emitting device of the other embodiment of the present invention.

And more, the entire LED light-emitting device is provided with a spring 50 additionally therein between the metal end cover 40 and the battery 31 of the battery assembly 30 so as to increase the effect of contact of the battery 31 with the metal end cover 40 to keep the circuit stable; as shown in FIG. 5, then a transparent cover 70 is mounted in the socket 11 of the metal cylinder 10, the transparent cover 70 has the same sliding effect as the socket 11 has, and the LED 21 can be fitted in the transparent cover 70, and the transparent cover 70 forms a protecting action for the LED 21. By means of pressing the transparent cover 70 to render the LED 21 to trigger the push switch 22, control of turning on/off of the LED 21 is attained; moreover, through the refraction of the transparent cover 70, effect of the LED 21 (the light source) is increased.

As the above mentioned, the cylindrical miniature-LED light-emitting device of the present invention provides a structure of the miniature-LED light-emitting device being simple structurally and convenient in operation, and especially meets the requirement of designing of the miniature-LED light-emitting device. Although this invention has been disclosed and illustrated with reference to a particular embodiment, it is not for giving any limitation to the scope of the present invention. It will be apparent to those skilled in this art that various equivalent modifications in structure, assembling and features without departing from the spirit of this invention shall fall within the scope of the appended claims.

What is claimed is:

1. A cylindrical miniature-LED light-emitting device comprising:

a metal cylinder having a main body configured to receive an LED assembly and a battery assembly;

said metal cylinder is provided on a front end thereof with a socket configured to receive an LED, and said metal cylinder is provided on a rear end thereof with a first thread section to threaded on a metal end cover;

said LED assembly comprises said LED and a push switch, and said LED assembly is installed inside of said metal cylinder, said LED protrudes from said socket to the front end of said metal cylinder;

said battery assembly comprises at least a battery and a bush, said battery assembly is installed inside of said metal cylinder, said LED assembly of said battery is connected with said push switch;

a metal end cover provided with a second thread section is threaded on the rear end of said metal cylinder to form an electric current path between said battery and said metal cylinder;

said LED light-emitting device operates when said LED is pressed on the front end of said metal cylinder and said push switch for controlling turning on/off of said LED is activated; said LED light-emitting device operates when said push switch is directly touched by said LED.

2. The cylindrical miniature-LED light-emitting device as in claim 1, wherein a spring is provided between said metal end cover and said battery of said battery assembly.

3. The cylindrical miniature-LED light-emitting device as in claim 1, wherein a transparent cover is mounted in said socket of said metal cylinder, said LED is fitted in said transparent cover, and said transparent cover protects said LED.

4. The cylindrical miniature-LED light-emitting device as in claim 1, wherein said metal end cover is provided with a through ring so that said LED light-emitting device connects with an extending-through-for-hanging item such as a key ring.

* * * * *